US007114626B2

(12) United States Patent
Tanaka et al.

(10) Patent No.: US 7,114,626 B2
(45) Date of Patent: Oct. 3, 2006

(54) SYNTHETIC RESIN CONTAINER HAVING A RECTANGULAR TUBULAR SHAPE

(75) Inventors: Toshimasa Tanaka, Tokyo (JP); Shigeru Tomiyama, Tokyo (JP); Tomoyuki Ozawa, Tokyo (JP); Takao Iizuka, Tokyo (JP); Naoki Tsutsui, Tokyo (JP)

(73) Assignee: Yoshino Kogyosho Co., Ltd., Tokyo (JP)

( * ) Notice: Subject to any disclaimer, the term of this patent is extended or adjusted under 35 U.S.C. 154(b) by 192 days.

(21) Appl. No.: 10/494,579

(22) PCT Filed: Nov. 29, 2002

(86) PCT No.: PCT/JP02/12495

§ 371 (c)(1),
(2), (4) Date: May 25, 2004

(87) PCT Pub. No.: WO03/045792

PCT Pub. Date: Jun. 5, 2003

(65) Prior Publication Data

US 2004/0256399 A1 Dec. 23, 2004

(30) Foreign Application Priority Data

Nov. 30, 2001 (JP) ..... 2001-367952
Nov. 26, 2002 (JP) ..... 2002-341832

(51) Int. Cl.
*B65D 1/18* (2006.01)
*B65D 1/46* (2006.01)

(52) U.S. Cl. ..... 215/382; 220/675

(58) Field of Classification Search ..... 215/379, 215/381–383; 220/669, 671, 675
See application file for complete search history.

(56) References Cited

U.S. PATENT DOCUMENTS

| | | | | | |
|---|---|---|---|---|---|
| 3,308,997 | A | * | 3/1967 | Kelly | 222/475 |
| 5,067,622 | A | * | 11/1991 | Garver et al. | 215/381 |
| D366,421 | S | * | 1/1996 | Best | D9/542 |
| 5,499,730 | A | * | 3/1996 | Harbour | 215/382 |
| 5,593,056 | A | * | 1/1997 | Mero et al. | 215/382 |
| D378,353 | S | * | 3/1997 | Emre et al. | D9/542 |
| D387,279 | S | * | 12/1997 | Emre et al. | D9/542 |
| D398,539 | S | * | 9/1998 | Guislain | D9/564 |
| 5,988,417 | A | * | 11/1999 | Cheng et al. | 215/383 |
| D427,077 | S | * | 6/2000 | Heliste et al. | D9/543 |
| 6,161,713 | A | * | 12/2000 | Krich | 215/384 |
| D439,166 | S | * | 3/2001 | Denner et al. | D9/538 |
| 6,974,047 | B1 | * | 12/2005 | Kelley et al. | 215/381 |

FOREIGN PATENT DOCUMENTS

| | | | |
|---|---|---|---|
| JP | A 62-52034 | | 3/1987 |
| JP | U 6-80612 | | 11/1994 |
| JP | 826239 | * | 1/1996 |
| JP | 8301253 | * | 1/1996 |
| JP | 10175625 | * | 6/1998 |

(Continued)

*Primary Examiner*—Sue A. Weaver
(74) *Attorney, Agent, or Firm*—Oliff & Berridge, PLC

(57) ABSTRACT

In a bottle-shaped synthetic resin container having a body part of substantially rectangular tubular shape, groove ribs, having a comparatively wide vertical groove form, are depressingly provided at the centers in the width direction of flat wall portions of shoulder lower end parts, which are portions of a shoulder part that connect with the body part, to make these portions higher in rigidity and difficult to deform and, even when a deformation occurs, prevent the deformation from becoming a permanent deformation. Safe handling of the container is thus promoted, especially for the stacked storage of containers in a sideways-laid orientation.

12 Claims, 18 Drawing Sheets

FOREIGN PATENT DOCUMENTS

| | | | |
|---|---|---|---|
| JP | 11100018 | * | 4/1999 |
| JP | 200072123 | * | 3/2000 |
| JP | 200085738 | * | 3/2000 |
| JP | A 2001-322616 | | 11/2001 |
| JP | 2002145233 | * | 5/2002 |
| JP | A 2002-166916 | | 6/2002 |

* cited by examiner

Fig. 9

| T(mm) | 1 | 2 | 3.5 | 4 | 4.5 | 6 | 7 | 8 | 9 | 10 | 11 | 13.5 | 18 |
|---|---|---|---|---|---|---|---|---|---|---|---|---|---|
| T/W (W=38mm) | 0.03 | 0.05 | 0.09 | 0.11 | 0.12 | 0.16 | 0.18 | 0.21 | 0.24 | 0.26 | 0.29 | 0.36 | 0.47 |
| P(kg) | 1.47 | 1.55 | 1.57 | 1.62 | 1.62 | 1.66 | 1.69 | 1.75 | 1.71 | 1.63 | 1.39 | 1.27 | 1.19 |

Fig. 11

| T(mm) | 3.5 | 4 | 4.5 | 6 | 7 | 8 | 9 | 10 | 11 | 13.5 | 18 |
|---|---|---|---|---|---|---|---|---|---|---|---|
| T/W (W=38mm) | 0.09 | 0.11 | 0.12 | 0.16 | 0.18 | 0.21 | 0.24 | 0.26 | 0.29 | 0.36 | 0.47 |
| P(kg) | 1.53 | 1.56 | 1.56 | 1.57 | 1.6 | 1.66 | 1.62 | 1.54 | 1.32 | 1.2 | 1.13 |

Fig. 13

| R(° ) | 30 | 45 | 70 | 90 |
|---|---|---|---|---|
| P(kg) | 1.6 | 1.62 | 1.66 | 1.71 |

Fig. 15

| D(mm) | 0.5 | 1 | 1.5 | 2 | 2.5 |
|---|---|---|---|---|---|
| P(kg) | 1.41 | 1.54 | 1.62 | 1.66 | 1.67 |

Fig. 17

| r(° ) | 75 | 10 | 85 | 90 | 95 | 100 | 105 | 110 |
|---|---|---|---|---|---|---|---|---|
| T'(mm) | 14.69 | 12.74 | 10.86 | 9.0 | 7.14 | 5.26 | 3.31 | 1.28 |
| P(kg) | 1.3 | 1.5 | 1.64 | 1.62 | 1.66 | 1.59 | 1.58 | 1.61 |

SYNTHETIC RESIN CONTAINER HAVING A RECTANGULAR TUBULAR SHAPE

TECHNICAL FIELD

This invention concerns a synthetic resin container having a body part with a substantially rectangular tubular shape.

BACKGROUND ART

With a prior-art synthetic resin container, having a body part of substantially rectangular tubular shape, such as a biaxially-oriented, blow-molded bottle made of polyethylene terephthalate, the lower end of the rectangular tubular body part is closed with a bottom part that is curvingly depressed into the body part and a cylindrical mouth tube part is connected to the upper end of the body part via a shoulder part, which is continuous with the body part and has a truncated rectangular pyramidal tubular shape.

Also, a peripheral groove for reinforcing the buckling strength is provided along the periphery at a substantially central position in the height direction of the body part, the flat wall portions are provided with pressure reduction absorbing panels that deform in a depressed manner to absorb the pressure reduction that occurs inside a closed container, and the corner parts of the body part are corner wall parts with the edges removed.

Such synthetic resin containers having a body part of substantially rectangular tubular shape provide the advantage of hardly giving rise to any dead space when stored in cardboard boxes and handled for transport, etc., and thereby enabling efficient handling.

However, with the above-described prior art, when containers, containing contents in a sealed manner, are laid sideways and stacked on top of each other and a set of upper and lower containers are set in a state where the flat wall portion of the body part of one container abuts an edge-removed corner wall part of the other container, a portion extending from the body part to the corner part of the container, the flat wall portion of which is abutted against the corner wall part of the other container, deforms in a bending and depressed manner and this depression deformation increases and develops into permanent deformation with the elapse of time.

This invention has been made to resolve the above problem of the prior art and a technical theme thereof is to increase the resistance of the portion extending from the body part to the shoulder part of a rectangular tubular synthetic resin container against external forces from the sides, and an object of this invention is to enable stacked storage of such a type of synthetic resin container in a sideways-laid orientation, for example, stacked storage in a sideways-laid orientation in an automatic vending machine to be achieved and maintained safely.

DISCLOSURE OF THE INVENTION

The means of a first claim of this invention achieves the above-described technical theme by an arrangement wherein a body part, having a rectangular tubular shape with edges removed from corner parts and having connected to the lower end thereof a bottom part forming a leg part, has erected on and connected to the upper end thereof a shoulder part of substantially rectangular tubular shape that is continuous with the body part, a cylindrical mouth tube part is erected at the upper end of this shoulder part, and groove ribs of vertical groove form are depressed at the centers in the width direction of flat wall portions of shoulder lower end parts, which are the portions of the shoulder part that connect with the body part.

With the invention of the first claim, since the body part of the container is of a substantially rectangular tubular shape, under normal conditions when such containers are stacked in a sideways-laid orientation, the flat wall portions of the body parts contact each other so as to realize a stable, stacked state in which excessive forces are not applied among containers.

However, when for some reason, for example, due to a shift of relative position inside a container dropping path within an automatic vending machine, one of the containers in a mutually stacked state becomes oriented with respect to another container so that a corner part thereof hits the other container's flat wall portion and causes a pressing force to act from a side onto an upper end part of the body part of the container, since a central portion, extending from the upper end part of the body part to the shoulder lower end part, which is the portion that undergoes curving deformation most readily, is made, by the groove ribs, to be of a structure that does not undergo bending deformation readily, depression deformation occurs in a form in which the entire central portion including the groove ribs undergo depression displacement and thus this portion extending from the upper end part of the body part to the shoulder lower end part exhibits strong resistance against an external pressing force.

Also, since this depression deformation due to a pressing force of the portion extending from the upper end part of the body part to the shoulder lower end part is not a bending depression deformation but is a simple curving depression deformation, even if the depression deformation state lasts for a long period of time, the container will return to its original shape naturally due to its own resilience when the pressing force that is the external force is removed and will thus not undergo permanent deformation.

With the invention of a second claim, the arrangement of the invention of the first claim is provided with a structure wherein each groove rib is arranged as a structure with which groove side walls are connected in a bent manner with the respective side ends of a flat groove bottom wall, and additionally, the ratio T/W of a rib width, which is the width of the lower end edge of the groove rib, with respect to a shoulder width W, which is the width of the lower end edge of the shoulder lower end part, is set in the range of 0.03 to 0.30.

With the invention of the second claim, since the rigidity, as measured by pressing by 2.3 mm with a square rod with edges of 10 mm each, of the front shoulder lower end part of a prior-art container with a structure without groove ribs is 1.16, the upper limit of the ratio T/W is set to 0.30 to realize a rigidity of 1.30 or more, which is substantially satisfactory in comparison to the prior-art rigidity. The lower limit of the ratio T/W is set to 0.03 since though a rigidity of 1.30 or more can be obtained by a lower ratio, the forming of the groove ribs themselves becomes difficult at a lower ratio.

With the invention of a third claim, the range of the ratio T/W of the second claim is specified as being 0.18 to 0.24.

With the invention of the third claim, by specifying the range of the ratio T/W as being 0.18 to 0.24, the rigidity can be made 1.60 or more and thus significantly high and the thinning of the container can thereby be promoted without lowering the rigidity of the shoulder part.

With the invention of a fourth claim, the setting of a side wall angle R, which is the rise angle of a groove side wall with respect to the groove bottom wall, in the range of 30° to 90° is added to the arrangement of the invention of the second or third claim.

Definite increase of the rigidity is attained by combining the invention of the fourth claim with the invention of the second or third claim, and the side wall angle R is set to 30° or more since if this side wall angle R is no more than 30°, the degree of increase of rigidity that is obtained by providing groove ribs drops drastically. Oppositely, the side wall angle R is set to 90° or less since it is extremely difficult in terms of molding to make the side wall angle R no less than 90°.

With the invention of a fifth claim, the setting of a rib depth D, which is the depth of a groove rib, in the range of 0.5 to 2.5 [mm] is added to the invention of the second, third, or fourth claim.

Definite increase of the rigidity is attained by combining the invention of the fifth claim with the invention of the second, third, or fourth claim, and the rib depth D is set to 0.5 mm or more since if this is no more than 0.5 mm, the degree of increase of rigidity that is obtained by providing groove ribs drops drastically. Oppositely, the depth is set to 2.5 mm or less since considerable difficulty arises in the molding of the container when the depth is no less than 2.5 mm.

With the invention of the sixth claim, the setting of a rib side face angle r, which is the rise angle of each side edge of a groove rib with respect to the lower end edge of the groove rib, in the range of more than 85° and preferably in the range of 85° to 95° is added to the invention of the second, third, fourth, or fifth claim.

Definite increase of the rigidity is attained by combining the invention of the sixth claim with the invention of the second, third, fourth, or fifth claim, and the rib side face angle r is set to 85° or more since if the rib side face angle r is no more than 85°, the degree of increase of rigidity that is obtained by providing groove ribs drops drastically. Also, when the rib side face angle r is set in the range of 85° to 95°, the rigidity that is obtained by providing groove ribs can be maximized (to 1.6 or more).

BRIEF DESCRIPTION OF THE DRAWINGS

FIG. 9 is a first diagram of rigidity analysis results for cases of varying the rib width with respect to the shoulder width.

FIG. 11 is a second diagram of rigidity analysis results for cases of varying the rib width with respect to the shoulder width.

FIG. 13 is a rigidity analysis results diagram for cases of varying the side wall angle.

FIG. 15 is a rigidity analysis results diagram for cases of varying the rib depth.

FIG. 17 is a rigidity analysis results diagram for cases of varying the rib side face angle.

BEST MODE FOR CARRYING OUT THE INVENTION

An embodiment of this invention shall now be described with reference to the drawings.

Figure 1:
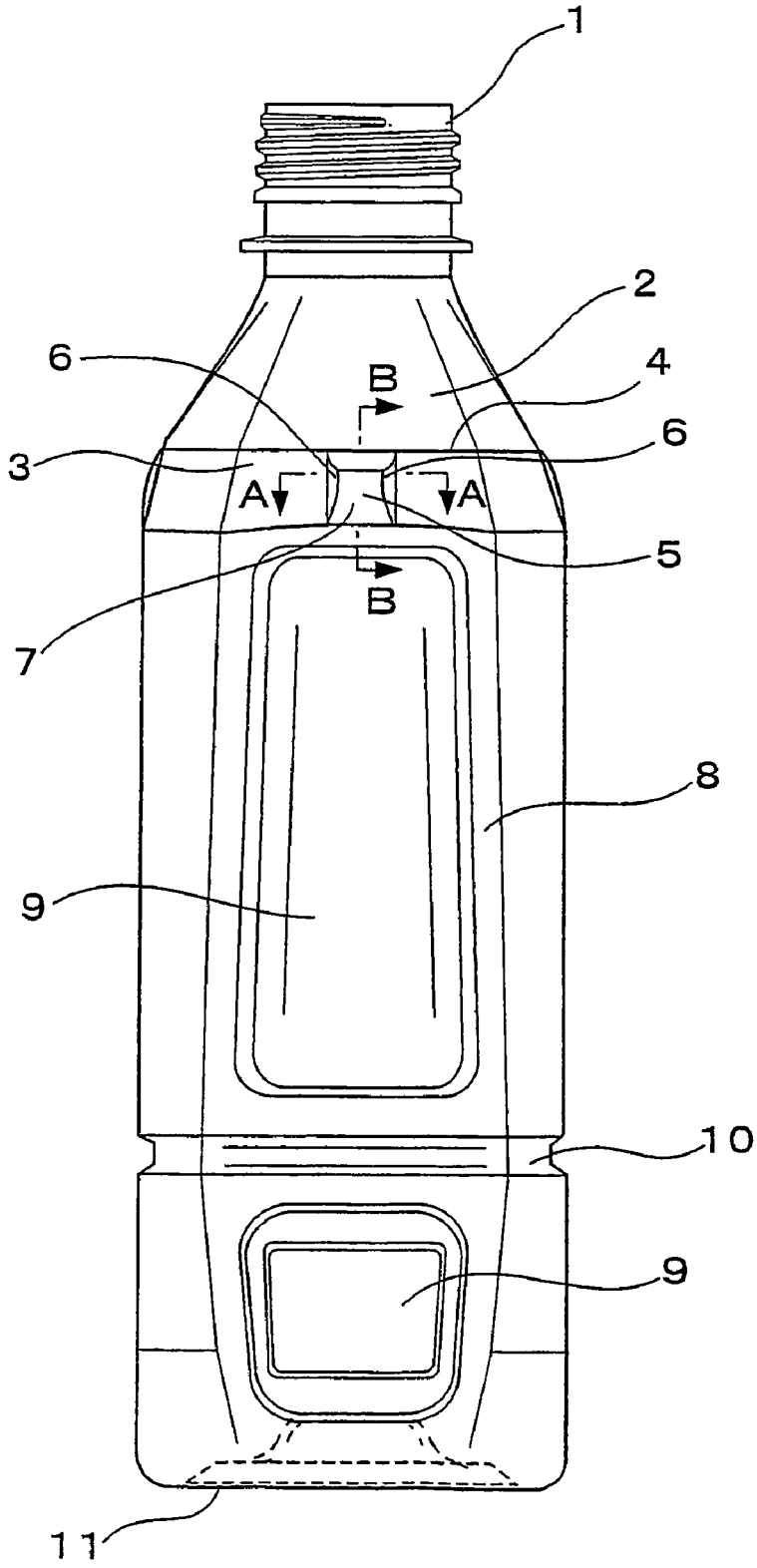
FIG. 1 is an overall front view showing an embodiment of this invention.
Figure 2:
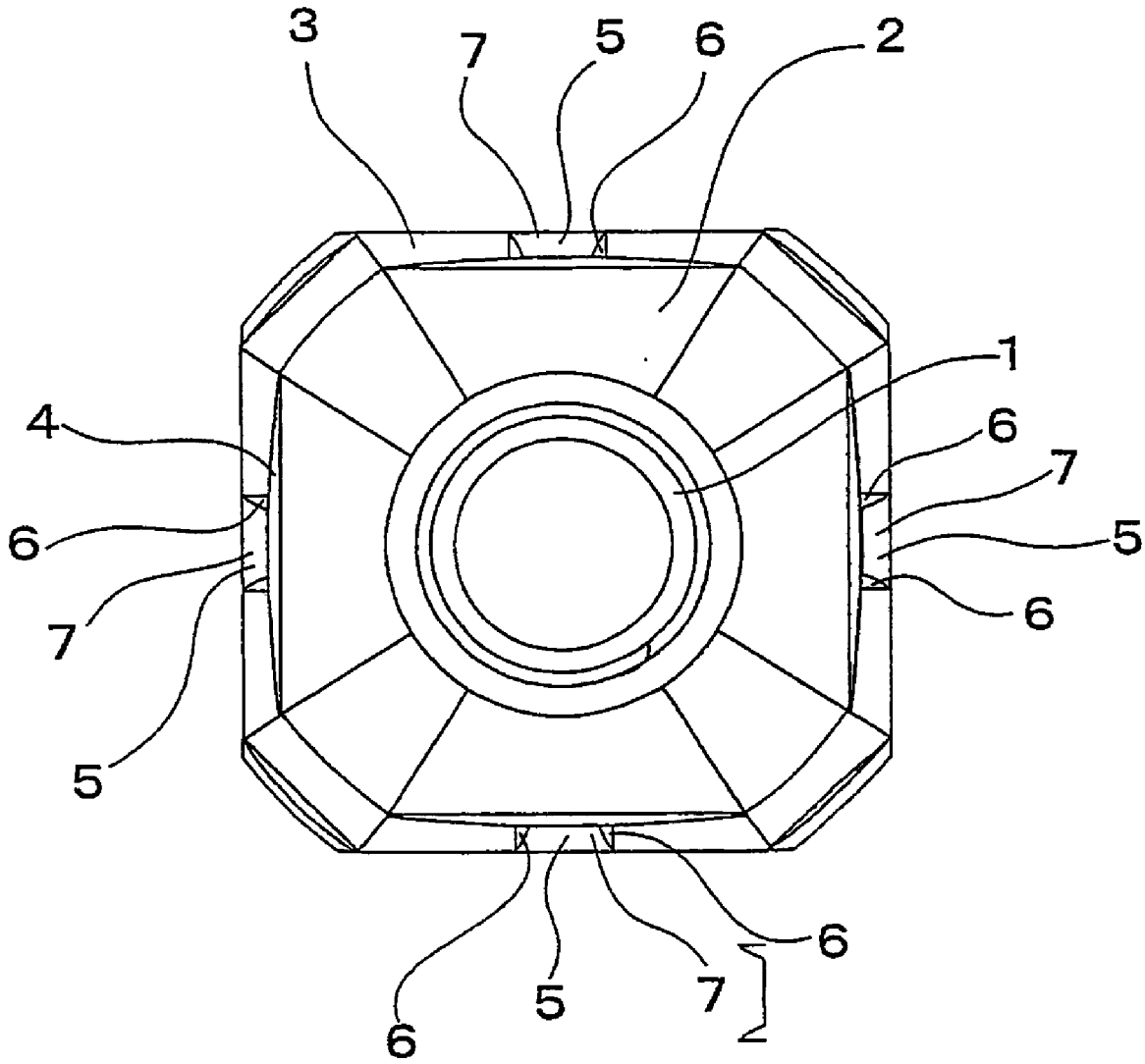
FIG. 2 is a plan view of the embodiment shown in FIG. 1.

FIG. 1 is an overall front view showing an embodiment of a container by this invention, which has a structure wherein a shoulder part 2, having substantially a truncated rectangular pyramidal tubular shape, is connected to the upper end of a body part 8, having a rectangular tubular form with edges removed from corner parts and having the lower end thereof closed by a bottom part 11 that forms a leg part and is depressed inwards, and a cylindrical mouth tube part 1, provided with threads and a neck ring on the outer circumferential face, is connected to the upper end of this shoulder part 2. A thin, biaxially-oriented, blow-molded bottle made of polyethylene terephthalate is thus arranged.

Figure 3:
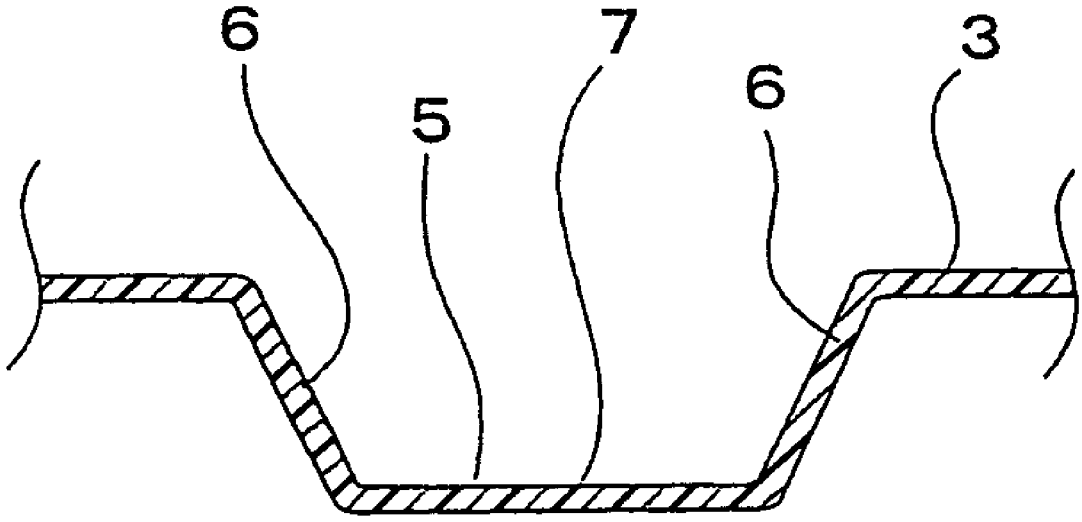
FIG. 3 is a partially enlarged sectional view across line A—A of FIG. 1.
Figure 4:
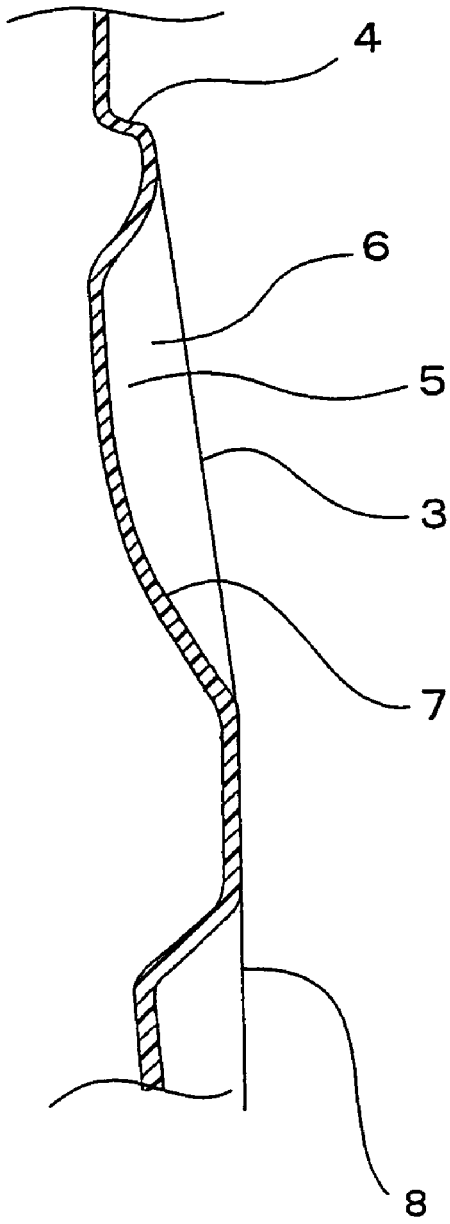
FIG. 4 is a partially enlarged sectional view across line B—B of FIG. 1.

The lower end parts of shoulder part 2 are arranged as shoulder lower end parts 3, each with an upward step part 4 as a boundary, and at the central portion in the width direction of each shoulder lower end part 3, a groove rib 5 of vertical groove form is depressed across the total height range of shoulder lower end part 3, and as shown in FIGS. 3 and 4, this groove rib 5 comprises a pair of groove side walls 6 and an inwardly bent groove bottom wall 7 and is provided at the flat wall portion of each shoulder lower end part 3.

At a somewhat lower position of body part 8, a peripheral groove 10 for reinforcement is depressed peripherally and on each flat wall portion of body part 8, which has been partitioned into upper and lower parts by this peripheral groove 10, is formed a panel wall 9 for absorbing reduced pressure that is generated inside the container.

Though omitted from illustration, a shrink label for indication of the trade name and decoration is externally fitted to this synthetic resin container, and the shrink label is attached well to the container by its upper end part being hitched onto step part 4 and its lower end part 10 being hitched onto peripheral groove 10.

Figure 5:
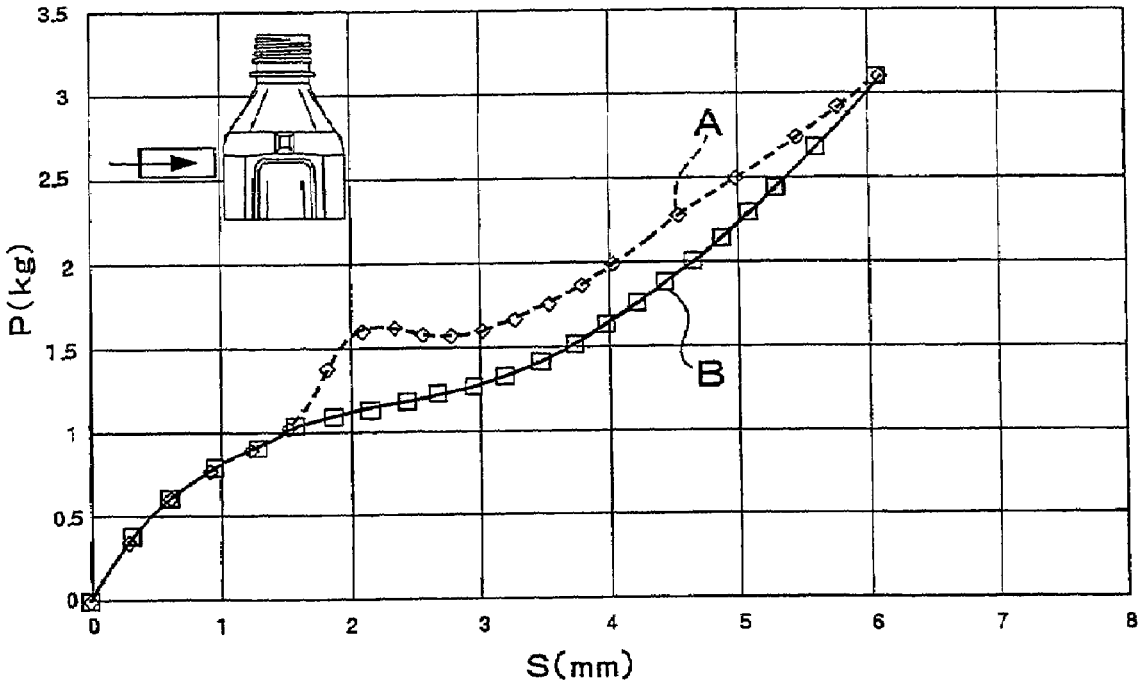
FIG. 5 is an analytical characteristics curve diagram showing this invention's characteristics of the deformation amount with respect to a load placed on the shoulder part.

Next, an analysis example of the relationship between the movement amount S of a rod and the pressing load P when a square rod with edges of 10 mm each is pressed against a part between a shoulder lower end part 3 and the upper end part of a body part 8 of a 500 ml bottle with a weight of 26.5 g is shown in FIG. 5 for a case where groove ribs 5 are provided and a case where the grooves are not provided. With this analysis example, each groove rib 5, as shown inside FIG. 5, has a structure with which groove side walls 6 are connected in a bent manner to a flat groove bottom wall 7.

As is clear from a comparison of the characteristics curve A for the case where groove ribs 5 are provided and the characteristics curve B for the case where groove ribs 5 are not provided in FIG. 5, whereas the pressing load (Kg), when the portion between shoulder lower end part 3 and the upper end part of body part 8 is depressingly deformed by 2 mm by pressing, that is, when the movement amount S=2 mm, is 1.1 in the case where there are no groove ribs 5, it is 1.6 in the case where groove ribs 5 are provided, and whereas the pressing load P (Kg), when the same part is depressingly deformed by 4 mm, that is, when the movement amount S=4 mm, is 1.6 in the case where there are no groove ribs 5, it is 2.0 in the case where groove ribs 5 are provided.

As is clear from these analysis results, in the case where the movement amount S=2 mm, the container with groove ribs 5 exhibits a rigidity that is 45% greater than the container without groove ribs 5, and in the case where the movement amount S=4 mm, the container with groove ribs 5 exhibits a rigidity that is 25% greater than the container without groove ribs 5.

Figure 6:
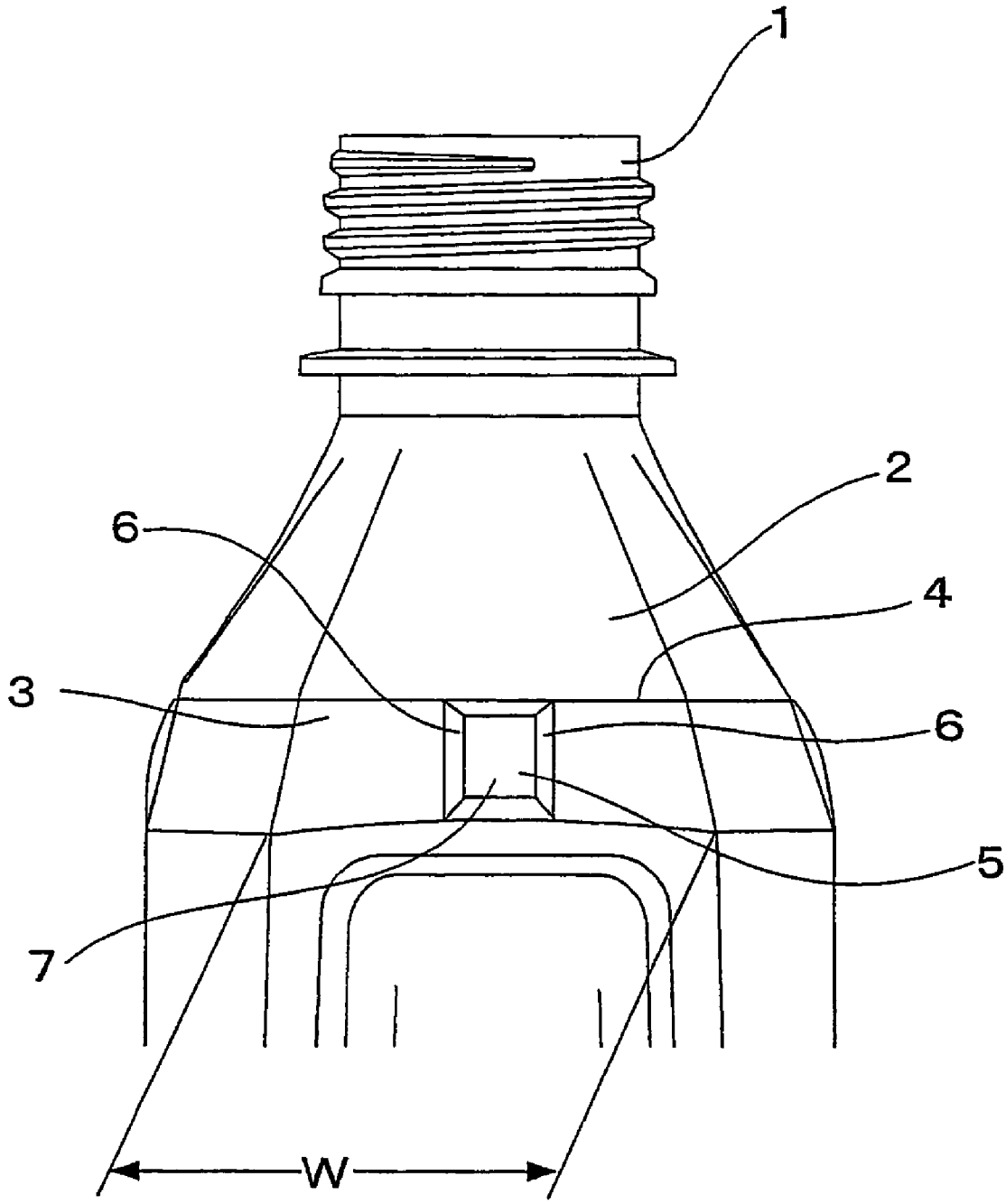
FIG. 6 is a partial front view showing a structure example used in the strength analysis of this invention.
Figure 7:
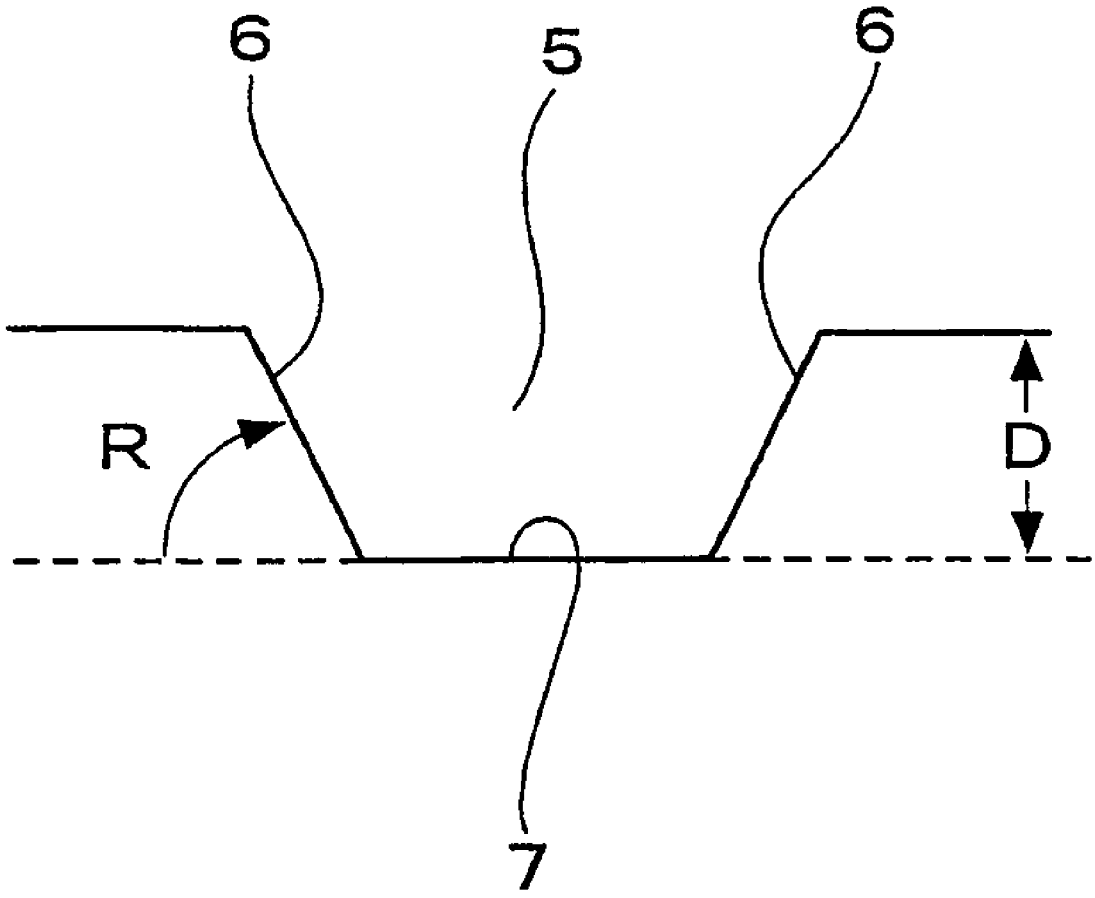
FIG. 7 is an enlarged planar sectional view of a groove rib used for the strength analysis.
Figure 8:
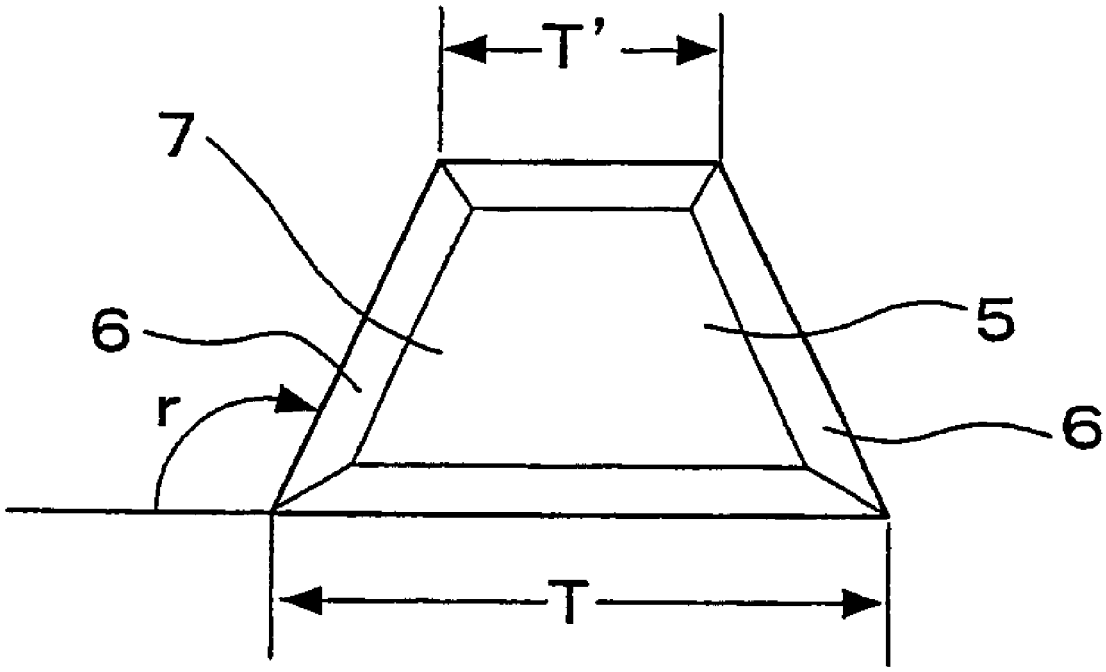
FIG. 8 is an enlarged front view of the groove rib used for the strength analysis.

Next as shown in FIG. 6, each groove rib 5 is provided at least with a structure with which groove side walls 6 are connected in a bent manner to both sides of a groove bottom wall 7 that is planar in shape, the width of the lower end edge of each shoulder lower end part 3 provided with groove rib 5 is set to a shoulder width W (see FIG. 6), the width of the lower end edge of each groove rib 5 is set to a rib width T (see FIG. 8), the width of the upper end edge of groove rib is set to a rib upper part width T' (see FIG. 8), the rise angle of a groove side wall 6 with respect to groove bottom wall 7 is set to a side wall angle R (see FIG. 7), the rise angle of a side edge of each groove rib 5 with respect to the lower end edge of the groove is set to a rib side face angle r (see FIG. 8), and the depth of each groove rib 5 is set to a rib depth D (see FIG. 7). The results of analyzing the rigidity of a portion between body part 8 and shoulder part 2 of the 500 ml bottle shown in FIG. 6 are indicated below.

This analysis is the rigidity analysis performed by pressing a square rod with edges of 10 mm each against shoulder lower end part 3 as shown in FIG. 5 under the condition that the thickness of shoulder lower end part 3 is 0.31 mm uniformly and the movement amount S=2.3 mm.

Figure 10:
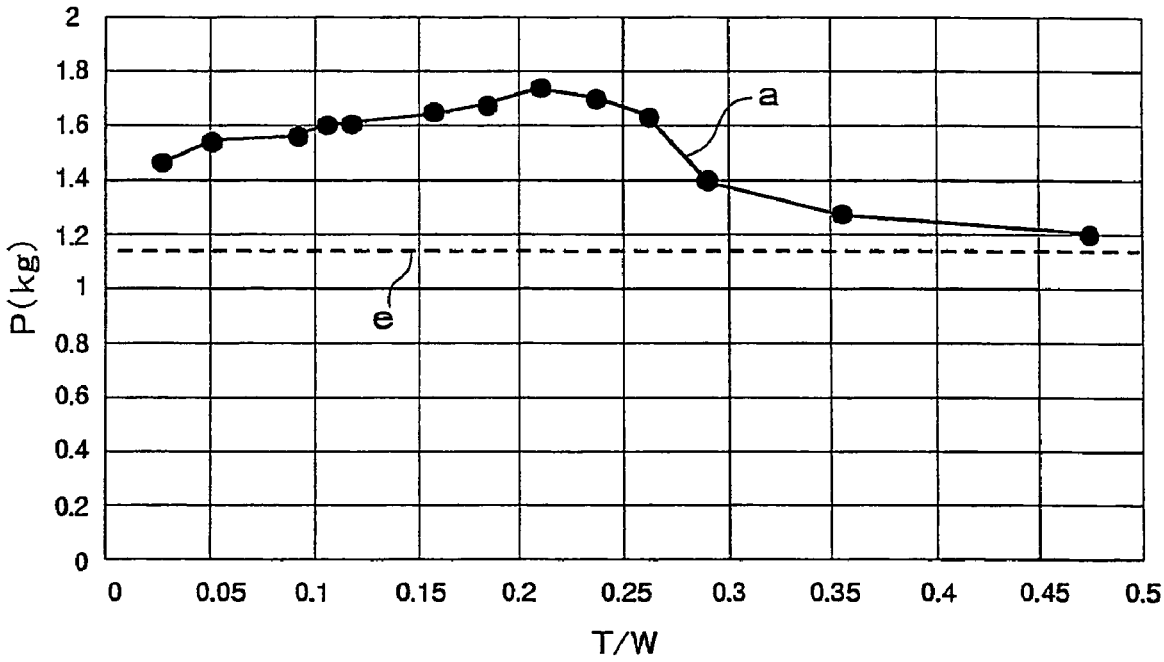
FIG. 10 is a characteristics curve diagram of the rib width to shoulder width ratio in which the results of FIG. 9 are illustrated in the form of a curve diagram.

In FIG. 9, the rigidity is compared for different ratios T/W of the rib width T with respect to shoulder width W when the side wall angle R is fixed at 90°, the rib side face angle r is fixed at 90° (that is, T=T'), and the rib depth D is fixed at 1.5 mm, and the characteristics curve a of these results is shown in FIG. 10.

As is clear from FIGS. 9 and 10, in comparison to the no-groove-ribs characteristics curve e (fixed at 1.16), the rigidity is increased over the entire range in which the ratio T/W is less than or equal to 0.47 with the characteristics curve a.

Figure 12:
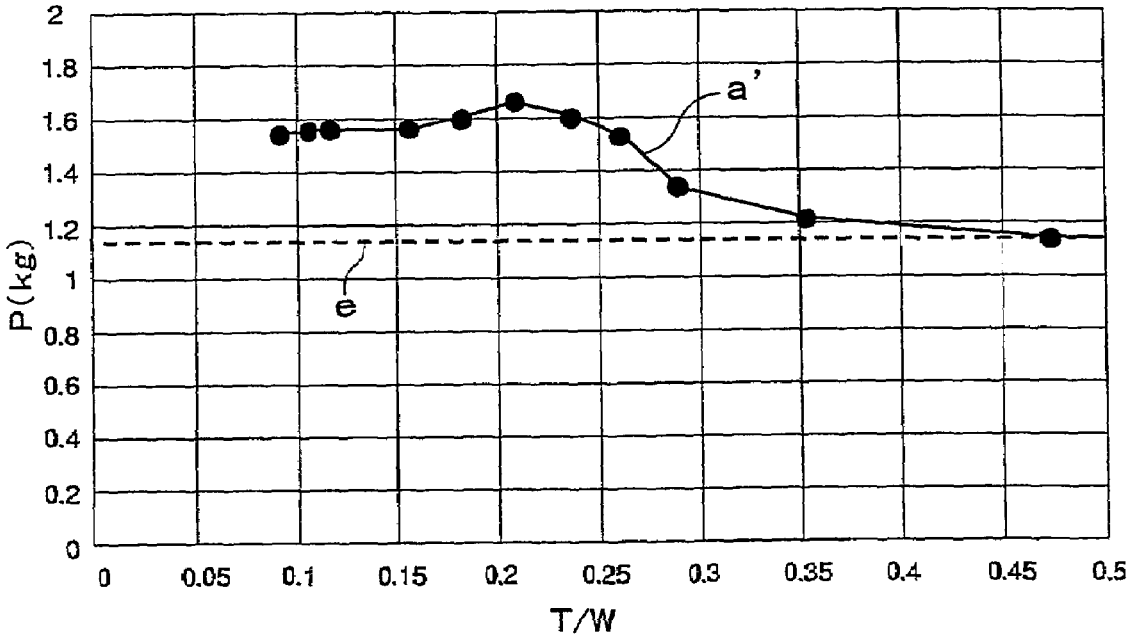
FIG. 12 is a characteristics curve diagram of the rib width to shoulder width ratio in which the results of FIG. 11 are illustrated in the form of a curve diagram.

In FIG. 11, the rigidity is compared for different ratios T/W for the same conditions as those of FIG. 9 with the exception that the side wall angle R is changed to 45°, and the characteristics curve a' of these results is shown in FIG. 12.

FIGS. 9 to 12 show that though there is the difference that when the side wall angle R is set to 90°, the rigidity is increased by approximately 5% in comparison to the case where the side wall angle R is set to 45°, the variations in the characteristics curve a and a' are substantially the same, and in both cases, a rigidity of 1.30 (Kg) or more, which is adequately satisfactory in comparison to the rigidity of 1.16 (Kg) of the no-groove-ribs case, is exhibited for a ratio T/W of 0.30 or less.

In particular, in a case where the ratio T/W is specified as being in the range of 0.18 to 0.24, the rigidity that is obtained becomes approximately 1.60 or more and an adequate rigidity can be obtained, and correspondingly, thinning of the container can be achieved readily without lowering the rigidity.

Figure 14:
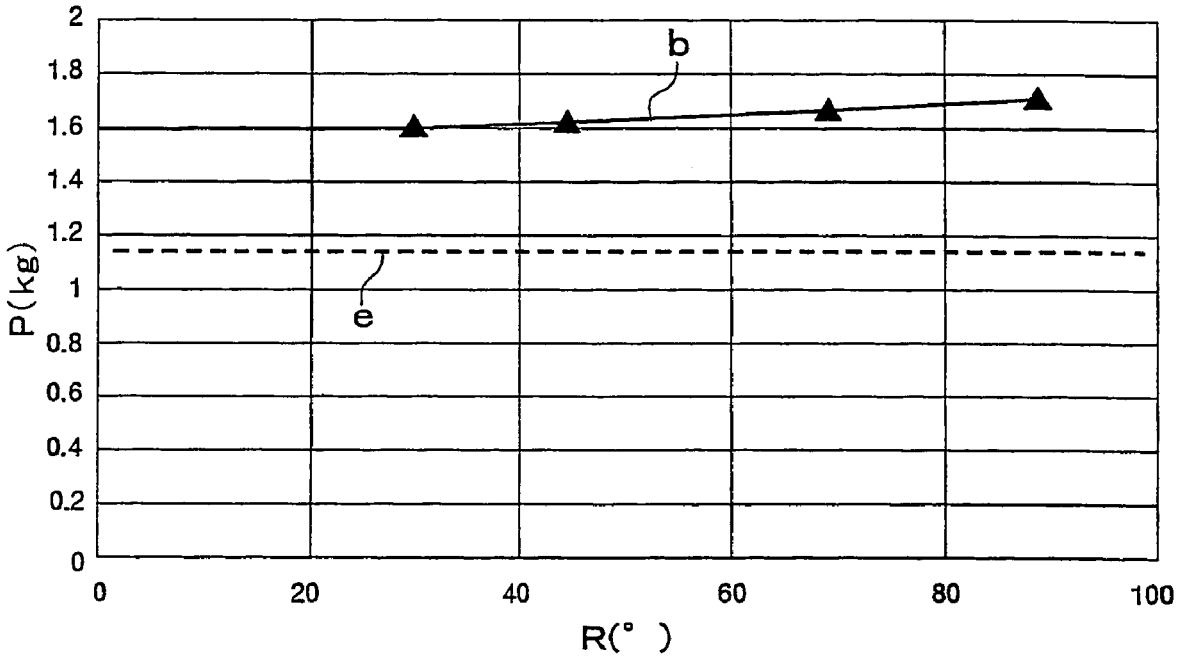
FIG. 14 is a characteristics curve diagram of the side wall angle and the rigidity in which the results of FIG. 13 are illustrated in the form of a curve diagram.

In FIG. 13, the rigidity is compared for different side wall angles R with the rib side face angle r being fixed at 90°, the rib depth D being fixed at 1.5 mm, and the rib width T being fixed at 9 mm, and the characteristics curve b of these results is shown in FIG. 14.

As is clear from the characteristics curve b, the side wall angle R and the rigidity vary in a substantially proportional manner, and it can be understood that as long as the molding conditions allow, it is advantageous to set the side wall angle R to a value close to 90°.

Figure 16:
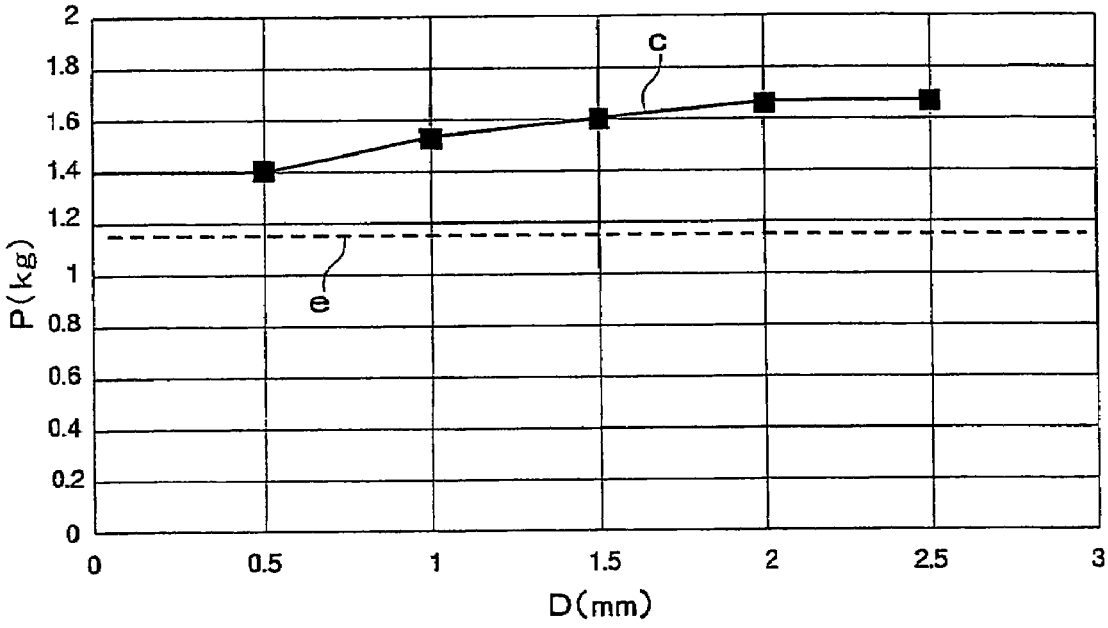
FIG. 16 is a characteristics curve diagram of the rib depth and the rigidity in which the results of FIG. 15 are illustrated in the form of a curve diagram.

In FIG. 15, the rigidity is compared for different rib widths D with the side wall angle R being fixed at 45°, the rib side face angle r being fixed at 90°, and the rib width T being fixed at 9 mm, and the characteristics curve c of these results is shown in FIG. 16.

Figure 18:
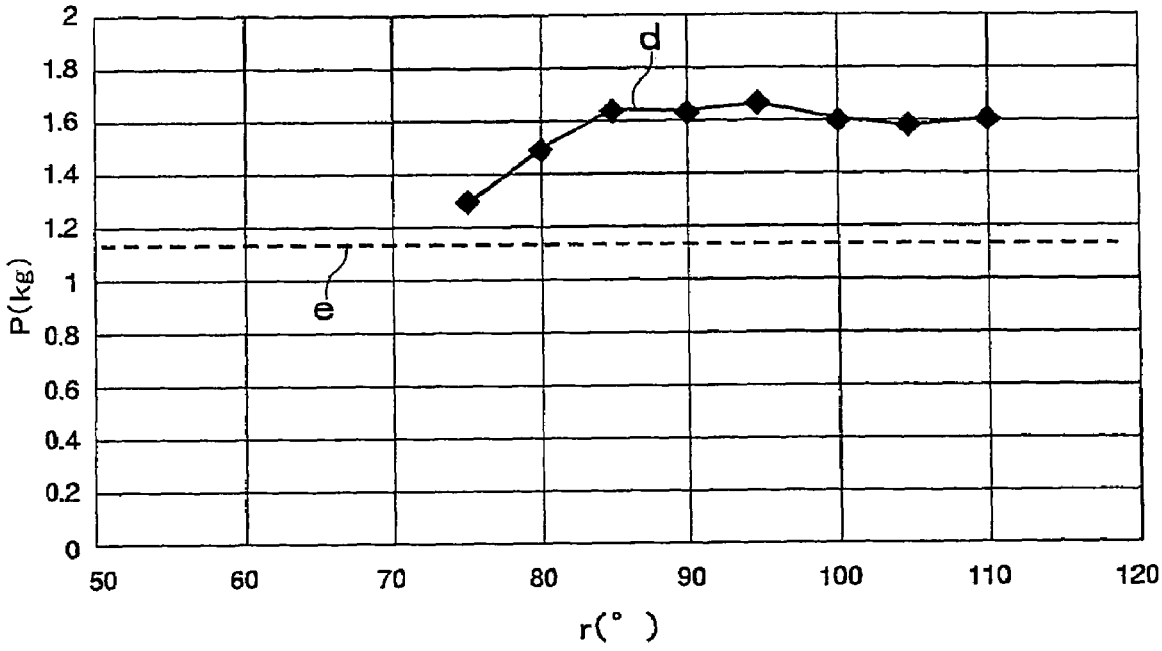
FIG. 18 is a characteristics curve diagram of the rib side face angle and the rigidity in which the results of FIG. 17 are illustrated in the form of a curve diagram.

As is clear from the characteristics curve c, though the rib depth D and the rigidity are in a relationship wherein the rigidity increases as the rib depth D increases, the degree of increase of the rigidity becomes more gradual as the rib depth D increases. Thus in consideration of the molding conditions of blow molding, it is advantageous to set the rib depth D in the range of 1.5 to 2.0 mm In FIG. 17, the rigidity is compared for different rib side face angles r with the side wall angle R being fixed at 45°, the rib width T being fixed at 9 mm, and the rib depth D being fixed at 1.5 mm, and the characteristics curve d of these results is shown in FIG. 18.

As is clear from the characteristics curve d, when the rib side face angle r becomes less than 85°, that is, when the tendency for the rib upper part width T' to become greater than the rib width T becomes strong, the rigidity tends to drop drastically, and in the range where the rib side face angle r is greater than 85°, that is, in the range where mainly the rib upper part width T' is less than the rib width T, the rigidity tends to decrease only slightly. It is thus advantageous to set the rib side face angle r to 85° or more.

In particular, when the rib side face angle r is specified to be in the range of 85° to 95°, a rigidity of 1.60 (Kg) or more can be obtained in a stable manner.

Though the above-described analysis concerned containers with a capacity of 500 ml, this invention is not limited in practice to containers with a capacity of 500 ml and can be applied to containers of various capacities.

Effect of the Invention

Since this invention is arranged as described above, it provides the following effects.

With the invention of the first claim, even when a pressing force acts from a side onto an upper end part of the body part of the container, since a central portion, which extends from the upper end part of the body part to the shoulder lower end part and is the portion that undergoes bending deformation most readily, is reinforced by the groove ribs so as not to undergo bending deformation readily and the deformation that occurs is a depression deformation of a form in which the entire central portion including the groove ribs undergo depression displacement, this portion extending from the upper end part of the body to the shoulder lower end part exhibits strong resistance against an external pressing force, is not deformed greatly, and enables the realization of a state in which containers are stacked with stability in a sideways-laid orientation.

Also, since this depression deformation that occurs at the portion extending from the upper end part of the body part to the shoulder lower end part is not a bending depression deformation but is a simple curving depression deformation, even if the depression deformation state lasts for a long period of time, the container will return to its original shape naturally due to its own resilience when the pressing force that is the external force is removed and will not undergo permanent deformation. Containers can thus be stored safely in a state in which the containers are stacked in a sideways-laid orientation.

Furthermore, since the rigidity of the portion extending from the shoulder lower end part to the upper end part of the body part can be increased adequately in terms of structure, thinning is enabled correspondingly and a high resource-saving effect is provided.

With the invention of the second claim, by setting the range of the ratio T/W of the rib width T with respect to the shoulder width W, the basic arrangement of increasing the rigidity by providing groove ribs can be made to have a rigidity of 1.30 or more, which is substantially satisfactory in comparison to the rigidity of 1.16 of the prior art, and the degree of rigidity increase thus obtained can be made to be of a fixed level or more, thus enabling stable and definite increase of the rigidity to be realized.

With the invention of the third claim, by specifying the range of the ratio T/W to be 0.18 to 0.24, significant increase of the rigidity can be realized, thereby enabling thinning of the container to be achieved without lowering the rigidity and enabling a large resource-saving effect to be obtained.

With the invention of the fourth claim, since as the side wall angle is increased, the function of a groove side wall as a reinforcing rib is strengthened and the rigidity can be increased correspondingly, the side wall angle can be increased within the range allowed by structural conditions and molding conditions to aid in increasing the rigidity.

With the invention of the fifth claim, since as the rib depth is increased, the function of a groove side wall as a reinforcing rib is strengthened and the rigidity can be increased correspondingly, the rib depth can be increased within the range allowed by structural conditions and molding conditions to aid in increasing the rigidity.

With the invention of the sixth claim, that the relationship between the rib width and rib upper part width is deeply involved in the rigidity increasing effect of the groove widths is clarified and the increase of rigidity by provision of groove ribs can thereby be made definite and effective.

What is claimed is:

1. A synthetic resin container, comprising:

a body part having a rectangular tubular shape with edges removed from corner parts, the body part having an upper end and a lower end;

a bottom part that forms a leg part, the bottom part being connected to the lower end of the body part;

a shoulder part having a substantially rectangular tubular shape that is continuous with the body part, the shoulder part being erected on and connected to the upper end of the body part;

a cylindrical mouth tube part erected at an upper end of the shoulder part; and groove ribs having a vertical groove form are depressed at the centers in a width direction of flat wall portions of shoulder lower end parts, which are the portions of the shoulder part that connect with the body part.

2. The synthetic resin container as set forth in claim 1, wherein each groove rib is arranged as a structure with which groove side walls are connected in a bent manner to the respective side ends of a flat groove bottom wall, and the ratio T/W of a rib width, which is the width of the lower end edge of said groove rib, with respect to a shoulder width, which is the width of the lower end edge of said shoulder lower end part, is set in the range of 0.03 to 0.30.

3. The synthetic resin container as set forth in claim 2, wherein the ratio T/W is specified in the range of 0.18 to 0.24.

4. The synthetic resin container as set forth in claim 2, wherein a side wall angle, which is the rise angle of a groove side wall with respect to the groove bottom wall, is set in the range of 30° to 90°.

5. The synthetic resin container as set forth in claim 2, wherein a rib depth, which is the depth of a groove rib, is set in the range of 0.5 to 2.5 [mm].

6. The synthetic resin container as set forth in claim 2, wherein a rib side face angle, which is the rise angle of the side edges of a groove rib with respect to the lower end edge of the groove rib, is set in the range of more than 85° and preferably in the range of 85° to 95°.

7. The synthetic resin container as set forth in claim 3, wherein a side wall angle, which is the rise angle of a groove side wall with respect to the groove bottom wall, is set in the range of 30° to 90°.

8. The synthetic resin container as set forth in claim 3, wherein a rib depth, which is the depth of a groove rib, is set in the range of 0.5 to 2.5 [mm].

9. The synthetic resin container as set forth in claim 4, wherein a rib depth, which is the depth of a groove rib, is set in the range of 0.5 to 2.5 [mm].

10. The synthetic resin container as set forth in claim 3, wherein a rib side face angle, which is the rise angle of the side edges of a groove rib with respect to the lower end edge of the groove rib, is set in the range of more than 85° and preferably in the range of 85° to 95°.

11. The synthetic resin container as set forth in claim 4, wherein a rib side face angle, which is the rise angle of the side edges of a groove rib with respect to the lower end edge of the groove rib, is set in the range of more than 85° and preferably in the range of 85° to 95°.

12. The synthetic resin container as set forth in claim 5, wherein a rib side face angle, which is the rise angle of the side edges of a groove rib with respect to the lower end edge of the groove rib, is set in the range of more than 85° and preferably in the range of 85° to 95°.

* * * * *

UNITED STATES PATENT AND TRADEMARK OFFICE

CERTIFICATE OF CORRECTION

PATENT NO. : 7,114,626 B2
APPLICATION NO. : 10/494579
DATED : October 3, 2006
INVENTOR(S) : Toshimasa Tanaka et al.

It is certified that error appears in the above-identified patent and that said Letters Patent is hereby corrected as shown below:

Column 5, line 34:

Please delete:
Groove rib

Replace with:
Groove rib 5.

Column 6, line 28:

Please delete:

As is clear from the characteristics curve c, though the rib depth D and the rigidity are in a relationship wherein the rigidity increases as the rib depth D increases, the degree of increase of the rigidity becomes more gradual as the rib depth D increases. Thus in consideration of the molding conditions of blow molding, it is advantageous to set the rib depth D in the range of 1.5 to 2.0 mm In FIG. 17, the rigidity is compared for different rib side face angles r with the side wall angle R being fixed at 45°, the rib width T being fixed at 9 mm, and the rib depth D being fixed at 1.5 mm, and the characteristics curve d of these results is shown in FIG. 18.

Replace with:

As is clear from the characteristics curve c, though the rib depth D and the rigidity are in a relationship wherein the rigidity increases as the rib depth D increases, the degree of increase of the rigidity becomes more gradual as the rib depth D increases. Thus in consideration of the molding conditions of blow molding, it is advantageous to set the rib depth D in the range of 1.5 to 2.0 mm.

UNITED STATES PATENT AND TRADEMARK OFFICE

CERTIFICATE OF CORRECTION

PATENT NO. : 7,114,626 B2
APPLICATION NO. : 10/494579
DATED : October 3, 2006
INVENTOR(S) : Toshimasa Tanaka et al.

It is certified that error appears in the above-identified patent and that said Letters Patent is hereby corrected as shown below:

In Fig. 17, the rigidity is compared for different rib side face angles r with the side wall angle R being fixed at 45°, the rib width T being fixed at 9 mm, and the rib depth D being fixed at 1.5 mm, and the characteristics curve d of these results is shown in FIG. 18.

Signed and Sealed this

Thirteenth Day of February, 2007

JON W. DUDAS
*Director of the United States Patent and Trademark Office*